US007367457B2

(12) United States Patent
Warlitz et al.

(10) Patent No.: US 7,367,457 B2
(45) Date of Patent: May 6, 2008

(54) DEVICE FOR THE SEPARATION OF NON-MAGNETIZABLE METALS AND FERROUS COMPONENTS FROM A SOLID MIXTURE AND METHOD FOR OPERATING SUCH DEVICE

(75) Inventors: Götz Warlitz, Elsdorf (DE); Klaus Dieter Feistner, Düren (DE); Uwe Habich, Aachen (DE); Harald Leinen, Pulheim (DE)

(73) Assignee: Steinert Elektromagnetbau GmbH, Köln (DE)

( * ) Notice: Subject to any disclaimer, the term of this patent is extended or adjusted under 35 U.S.C. 154(b) by 582 days.

(21) Appl. No.: 10/416,784

(22) PCT Filed: Nov. 16, 2001

(86) PCT No.: PCT/DE01/04269

§ 371 (c)(1),
(2), (4) Date: Sep. 5, 2003

(87) PCT Pub. No.: WO02/40172

PCT Pub. Date: May 23, 2002

(65) Prior Publication Data

US 2004/0040894 A1 Mar. 4, 2004

(30) Foreign Application Priority Data

Nov. 20, 2000 (DE) ..... 100 57 535

(51) Int. Cl.
*B03C 1/00* (2006.01)

(52) U.S. Cl. ..... 209/225; 209/229; 209/638

(58) Field of Classification Search ..... 209/218–221, 209/225, 229, 230, 631, 636, 638, 656, 657, 209/228; 464/127, 180; 198/760, 767, 837
See application file for complete search history.

(56) References Cited

U.S. PATENT DOCUMENTS

| | | | | | |
|---|---|---|---|---|---|
| 345,383 | A | * | 7/1886 | Kessler | 209/218 |
| 500,604 | A | * | 7/1893 | Payne | 209/214 |
| 1,729,008 | A | | 9/1929 | Osborne | |
| 2,081,445 | A | * | 5/1937 | Andrews et al. | 209/219 |
| 2,992,737 | A | * | 7/1961 | Buus | 209/223.1 |
| 3,770,097 | A | * | 11/1973 | Musschoot | 198/760 |
| 3,887,458 | A | * | 6/1975 | Laurila | 209/219 |
| 3,965,835 | A | * | 6/1976 | Bennett | 114/42 |
| 4,125,191 | A | * | 11/1978 | Peace | 209/636 |
| 4,137,156 | A | * | 1/1979 | Morey et al. | 209/212 |

(Continued)

FOREIGN PATENT DOCUMENTS

DE 38 17 003 10/1989

(Continued)

*Primary Examiner*—Patrick H. Mackey
*Assistant Examiner*—Mark Hageman
(74) *Attorney, Agent, or Firm*—Norris McLaughlin & Marcus, PA

(57) ABSTRACT

In an arrangement which including a motor-driven system for the separation of non-magnetisable metals, vibrations and resonances which generally are present in such arrangement, are eliminated. This is accomplished by utilizing a drum mounted on and rotating about a stator, within which a magnetic rotor fitted with permanent magnets is eccentrically arranged and mounted on said stator. The stator is provided with a balance weight for mass balance.

18 Claims, 3 Drawing Sheets

U.S. PATENT DOCUMENTS

| | | | | | |
|---|---|---|---|---|---|
| 4,480,754 | A | * | 11/1984 | Ewald | 209/683 |
| 4,525,271 | A | * | 6/1985 | Ewald | 209/303 |
| 4,781,821 | A | * | 11/1988 | Salmi | 209/214 |
| 4,895,551 | A | * | 1/1990 | Fritz | 464/180 |
| 5,092,986 | A | * | 3/1992 | Feistner et al. | 209/212 |
| 5,148,923 | A | * | 9/1992 | Fraenkel et al. | 209/539 |
| 5,394,991 | A | * | 3/1995 | Kumagai et al. | 209/212 |
| 5,431,289 | A | * | 7/1995 | Hoffman | 209/638 |
| 5,730,297 | A | * | 3/1998 | Lower et al. | 209/332 |
| 6,068,133 | A | * | 5/2000 | Schonfeld et al. | 209/219 |
| 6,109,427 | A | * | 8/2000 | Hosch et al. | 198/835 |
| 6,142,293 | A | * | 11/2000 | Ozawa et al. | 198/837 |
| 6,210,099 | B1 | * | 4/2001 | Hugbart et al. | 415/13 |
| 6,230,897 | B1 | * | 5/2001 | Exner | 209/219 |
| 6,467,629 | B1 | * | 10/2002 | Exner | 209/219 |
| 6,606,922 | B2 | * | 8/2003 | Case et al. | 464/180 |

FOREIGN PATENT DOCUMENTS

| | | | | |
|---|---|---|---|---|
| DE | 38 23 944 | C1 | | 11/1989 |
| DE | 42 07 335 | A1 | | 9/1993 |
| DE | 195 21 415 | A1 | | 1/1997 |
| EP | 0 342 330 | A2 | | 11/1989 |
| EP | 342330 | A2 | * | 11/1989 |
| JP | 402218451 | A | * | 8/1990 |
| JP | 404349947 | A | * | 12/1992 |

* cited by examiner

DEVICE FOR THE SEPARATION OF NON-MAGNETIZABLE METALS AND FERROUS COMPONENTS FROM A SOLID MIXTURE AND METHOD FOR OPERATING SUCH DEVICE

BACKGROUND OF THE INVENTION

The invention relates to a device with a system driven by a motor for separating non-magnetizable metals, in particular non-ferrous metals, and ferrous fractions that are present, from a solid mixture, with a drum that is supported on a stator and rotates around the stator, with a rotating magnet rotor fitted with permanent magnets eccentrically arranged in the rotating drum and supported in the stator. The invention also relates to a method for operating the device.

DESCRIPTION OF THE RELATED ART

Such devices and methods for separating non-magnetizable metals are known in the art.

For example, DE-C1-38 23 944 proposes a magnet system that is driven inside a belt drum with a rotation speed that is higher than the rotation speed of the belt drum. The outside diameter of the magnet system is herein smaller than the unobstructed inside diameter of the belt drum, and more importantly, the magnet system is arranged eccentrically in the belt drum.

DE-C1-38 17 003 discloses an improvement of this device, whereby the position of the eccentrically arranged magnet rotor in the quadrant of the material discharge zone and the effective range of the alternating magnetic field produced by the magnet rotor can be adjusted in the radial direction.

In order to improve the separation effect of the aforedescribed solid mixtures, after initial separation of the Fe-fraction, with respect to non-ferrous metals, DE-C2-195 21 415 constructively combines several conventional technical means, ranging from the feed regions of the solid mixture to the conveyor and discharge regions and the separation zones formed by the trajectories, to improve the purity of the recovered graded concentrates of the various material fractions.

The search for precious materials in recycling operations is still ongoing and new problems have arisen.

When non-magnetizable metals, such as non-ferrous metals, are separated from solid mixtures which are obtained after separation of the Fe-fraction, for example from a shredder light fraction, the purity of the recovered graded non-ferrous metal fraction should be increased not only to fetch a higher price, but also to economically separate mass flows of solid mixtures into reusable fractions.

It has been observed in practice that the aforedescribed solid mixtures still contain residual Fe - even after prior Fe-separation.

Processing mass flows of solid mixtures with the aforedescribed devices has led, among others, to the design of extremely wide drums and magnet rotors that are eccentrically arranged in the drums and rotate with the drums. This causes oscillations which negatively impact both the system structure and the separation effect.

SUMMARY OF THE INVENTION

It is an object of the invention to provide a device of the aforedescribed type, which can meet the requirements for industry-scale separation of non-magnetizable metals and any remaining Fe-fractions from solid mixtures, in particular after the Fe - fraction has been separated from the shredder light fraction. More particularly, the purity of the recovered graded non-ferrous metals has to be guaranteed, while the remaining Fe-fractions still have to be separated. A particular problem to be solved is a reduction and possible elimination of oscillations that occur in particular with extremely wide drums and possibly also with the connected conveyor belt systems as well as the elimination of corresponding resonances in the structure. The related method is intended to ensure the purity if the recovered graded concentrates.

An assembly is disclosed including a system driven by a motor for separating non-magnetizable metals, in particular non-ferrous metals, and ferrous fractions that are present, from a solid mixture, with a drum which is supported on a stator and which rotates around the stator. The system also includes a rotating magnet rotor fitted with permanent magnets eccentrically arranged in the rotating drum and supported in the stator. The stator is provided with a balance weight for balancing the mass. The balance weight is implemented as an oscillation damper. The balance weight also operates as an oscillation damper through adjustment of the angle by tilting the magnet rotor which is arranged eccentrically in the stator. In the region of the balance weight, a transport magnet is disposed for separating the Fe-fraction contained in the non-metals. The balance weight and the transport magnet form an assembly. Further, the balance weight may be a magnet.

The shape of the balance weight is such that it matches the shape of the drum shell of the drum and the shape of the balance weight also is matched to the shape of the magnetic field that is being generated. The balance weight may have a sickle-shaped cross-section perpendicular to the axis of the drum.

The magnet rotor comprises permanent magnets which may have different shapes, dimensions and polarities in both the radial and axial direction of the magnet rotor. The drum and the magnetic rotor, arranged eccentrically in the drum, may be incorporated as a header drum in a continuous conveyor belt system that conveys the solid mixture. At least one separation apex is arranged subsequent to the device, wherein the separation apex can be adjusted with the help of an adjusting device in cooperation with a means, for example a camera, which recognizes the corresponding composition of the separated fraction.

The speed of the drum is adjustable and the rotation speed of the magnet rotor is also adjustable. Both the angle of the magnet rotor, arranged in the stator about the rotation axis of the drum as well as the distance of the axis of the magnet rotor arranged in the stator relative to the rotation axis of the drum, are adjustable.

A conveyor belt of the conveyor belt system has a guide projection which is guided in a circumferential groove of the drum shell. The conveyor belt system is divided by the circumferential projection into two regions, with a dedicated separation.

The invention will be described herein after with respect to a complex embodiment, wherein different modifications of the device are illustrated which, when taken together, contribute to a solution of the problem.

BRIEF DESCRIPTION OF THE DRAWINGS

The drawings show in

DESCRIPTION OF THE PRESENTLY PREFERRED EMBODIMENTS

Figure 1:
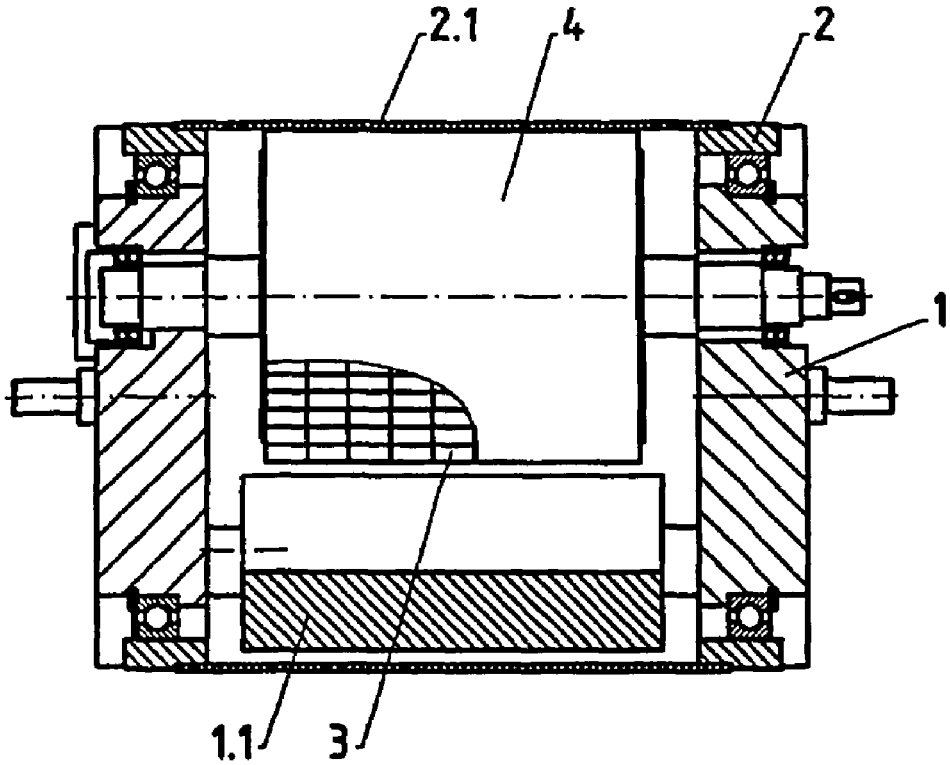
FIG. 1 a longitudinal cross-section through a drum with a magnet rotor eccentrically arranged in the drum and a balance weight according to the invention, FIG. 2 the cross-sectional view of FIG. 1 with the balance weight according to the invention and a transport magnet, FIG. 3 a schematic diagram of the device in a conveyor belt system with a connected separation apex and means for adjusting the separation apex, FIG. 4 a schematic diagram of the conveyor belt system with a circumferential projection disposed on the conveyor belt and associated separation apexes arranged subsequent to the conveyor belt regions, and FIG. 5 a partial cross-section through a drum shell.
Figure 2:
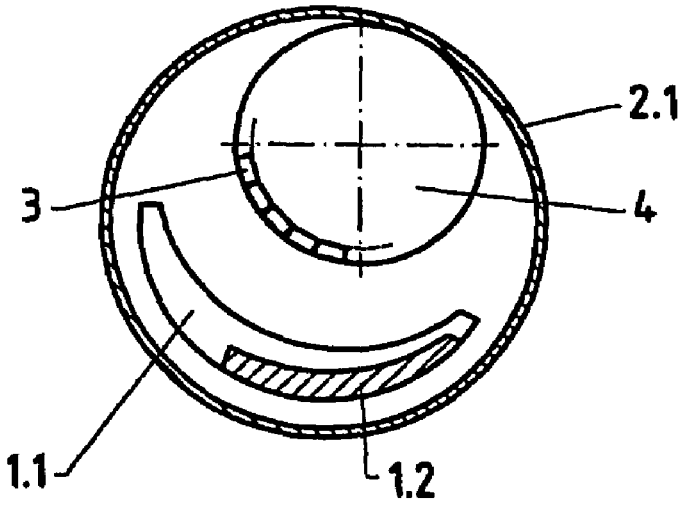

As depicted in FIGS. 1 and 2, the device according to the invention includes a drum 2 which is supported on a stator 1 and rotates about the stator 1. A rotating magnet rotor 4 fitted with permanent magnets 3 is eccentrically arranged in the drum 2 and supported in the stator 1. The functionality and operation of such device for separating non-magnetizable metals from a solid mixture is extensively described in the references addressing the state-of-the-art.

Figure 3:
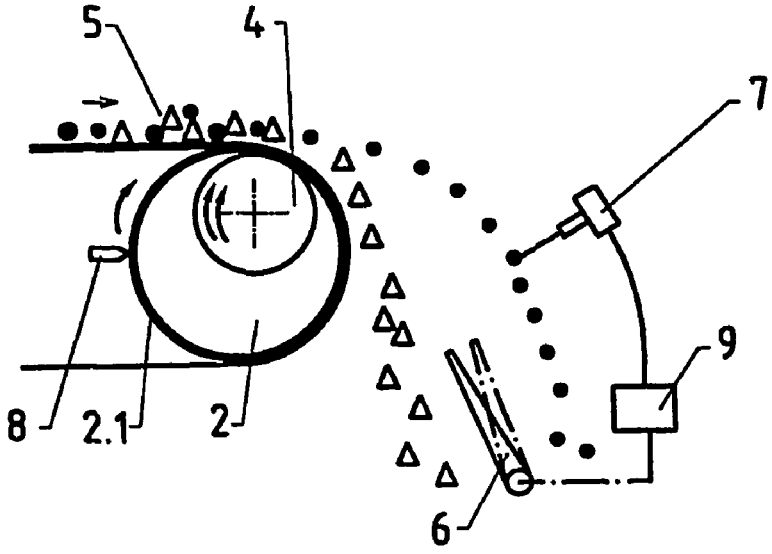
Figure 4:
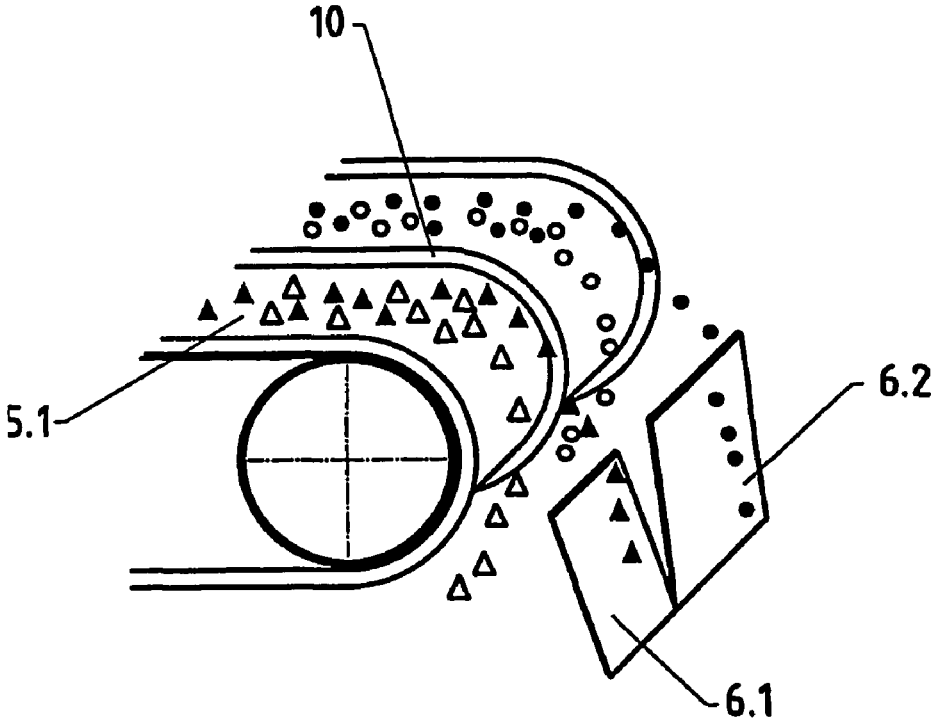
Figure 5:
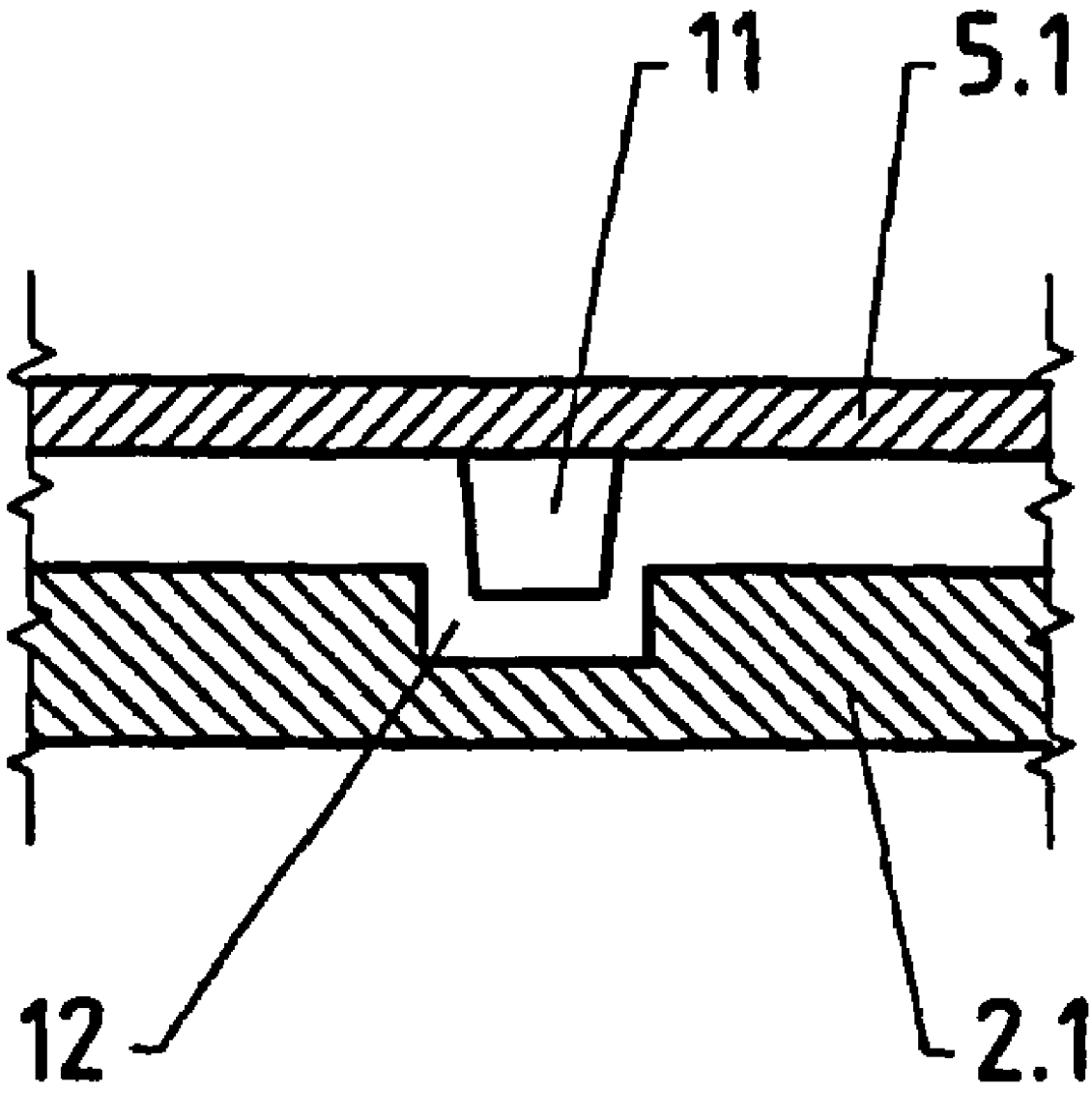

Since the separation effect in such devices is produced by tilting the magnet rotor 4 that is eccentrically arranged in the stator 1, a balance weight 1.1 is arranged on the stator 1 for mass balance. This balance weight 1.1 simultaneously operates as an oscillation damper, in particular when an extremely wide drum 2 and/or conveyor belt system 5, 5.1 are used, as illustrated in FIGS. 3, 4 and 5.

To separate from the solid mixture the remaining Fe-fraction in addition to the usually separated non-ferrous metals, the balance weight 1.1 is implemented as an assembly with a transport magnet 1.2 or as a magnet, wherein the shape of the balance weight 1.1 is matched to the shape of the drum 1.

To optimize the efficiency of the magnetic field and hence the separation effect, the shape of the balance weight 1.1 is matched to the shape of the magnetic field to be generated, and can have a technologically advantageous sickle-shaped cross-section.

Permanent magnets 3 of different shapes, dimensions and polarities in both the radial and axial direction of the magnet rotor 4 can additionally be fitted to the magnet rotor 4.

Such device implementation alone can satisfy the requirements for solving the problems addressed by the invention.

If the drum 2 with the magnetic rotor 4 that is arranged eccentrically in the drum is incorporated as a header drum in a continuous conveyor belt system 5 with a conveyor 5.1 that conveys the solid mixture (FIGS. 3, 4), followed by a separation apex, then a means 7, for example a camera, that recognizes the corresponding composition of the separated fraction the separation apex 6 can be provided, wherein the means 7 cooperates with an adjusting device 9 which adjusts the separation apex 6 to a corresponding concentrated graded composition of the separated fraction.

The separation effect is also enhanced in that the rotation speed of the drum and the rotation speed of the magnet rotor can be matched to the flow rate and/or composition of the solid mixture and that both the angle of the magnet rotor 4 about the rotation axis of the drum 2 as well as the distance of the axis of the magnet rotor 4 relative to the rotation axis of the drum 2 can be adjusted to obtain the desired trajectories for the non-ferrous metals to be separated.

For a very wide conveyor belt system 5 and conveyor belt 5.1, it may be advantageous for certain applications for separating solid mixtures to divide the conveyor belt system 5.1 into two regions with a circumferential projection 10, to arrange a dedicated separation apex 6.1, 6.2 after these regions, and to adjust the separation apexes (6.1, 6.2) independently of each other, so that different materials of solid mixtures can be subjected to pre-cleaning and post-cleaning.

As shown in FIG. 5, the conveyor belt 5.1 can be guided on a particularly wide drum 2 and the conveyor belt 5.1 can be prevented from leaving the running surface and/or the drum shell 2.1 on drum 2, by providing (see FIG. 5) a bead-like guide projection 11 in the conveyor belt 5.1. The guide projection 11 runs and is guided in a circumferential groove 12 of the drum shell 2.1.

To improve the separation quality, the upper edges of the separation apexes 6, 6.1, 6.2 can be implemented as a rotating cylinder (not shown).

In useful embodiments of the device of the invention, a stripping unit 8 (FIG. 3) can be arranged on the outer shell 2.1 of the drum 2 to prevent harmful fractioned particles from entering between the conveyor belt 5.1 and the drum shell 2.1.

For practical industrial applications, it is important to provide a method which guarantees the separation quality in the event of a power failure until the drive system comes to a halt. According to the method of the invention, the energy of the still rotating magnet rotor 4 is used for the motor (not shown) to drive the conveyor belt system 5, in order to drive the drum 2 with the other motor (not shown) of the magnet rotor 4 which now operates as a generator, long enough so that the remaining solid mixture, which was left on the conveyor belt system 4 when the power failed, can be separated. The magnet rotor (4) arranged in the stator (1) forms an angle about the rotation axis of the drum (2). said angle as well as a distance of the axis of the magnet rotor (4) arranged in the stator (1) relative to the rotation axis of the drum (2) are adjustable. The upper edge of the separation apexes (6.6.1.6.2) is implemented as a rotating cylinder for improving the separation quality.

INDUSTRIAL APPLICABILITY

The invention provides the industry with a device and a method for separating non-magnetizable metals and Fe-fractions from a solid mixture, which in addition to a compact device configuration provides a high separation quality and purity of the recovered graded fractions.

The invention claimed is:

1. A conveyor belt assembly including a motor-driven system for separating non-magnetizable metals and ferrous fractions that are present, from a solid mixture, comprising a stator (1) and a drum (2) supported on the stator (1) for moving the conveyor belt, the drum rotating around the stator, a rotating magnet rotor (4) including permanent magnets, the rotating magnet rotor being eccentrically arranged in the rotating drum (2) and supported on the stator (1), the stator (1) includes a balance weight (1.1) for providing mass balance and operating as an oscillation damper, the balance weight supported on the stator (1) and arranged in the rotating drum (2) a predetermined distance away from the stator (1) and the balance weight (1.1) compensates for oscillations produced from tilting the magnet rotor (4).

2. The assembly according to claim 1, wherein the balance weight (1.1) is shaped to match the shape of a magnetic field to be generated.

3. The assembly according to claim 1, wherein the balance weight (1.1) includes a sickle-shaped cross-section perpendicular to an axis of the drum (2).

4. The assembly according to claim 1, wherein the magnet rotor (4) comprises permanent magnets (3) having a shape, dimension and polarity in both a radial and an axial direction of the magnet rotor (4).

5. The assembly according to claim 1, wherein the drum (2) and the magnetic rotor (4) are formed as a header drum in a continuous conveyor belt system (5) that conveys the solid mixture.

6. The assembly according to claim 1, further comprising at least one separation apex (6) arranged subsequent to the assembly, wherein the separation apex (6) is adjusted by an adjusting device (9) in cooperation with a means for identifying (7) the composition of the separated ferrous fractions.

7. The assembly according to claim 1, wherein the rotating drum (2) has an adjustable speed.

8. The assembly according to claim 1, wherein the rotation of the magnet rotor (4) is adjustable.

9. The assembly according to claim 1, wherein the magnet rotor (4) arranged on the stator (1) forms an angle about the rotation axis of the drum (2), said angle as well as a distance of the axis of the magnet rotor (4) arranged in the stator (1) relative to the rotation axis of the drum (2) are adjustable.

10. The assembly according to claim 1, further comprising a transport magnet (1.2) disposed in a region of the balance weight (1.1) for separating the Fe-fraction contained in the non-metals.

11. The assembly according to claim 10, wherein the balance weight (1.1) and the transport magnet (1.2) form a subassembly.

12. The assembly according to claim 10, wherein the balance weight (1.1) is implemented as a magnet.

13. The assembly according to claim 1, wherein the rotating drum includes a drum shell (2.1) and wherein the balance weight (1.1) is matched in shape to the drum shell (2.1).

14. The assembly according to claim 13, further comprising a stripping unit (8) arranged on the drum shell (2.1) of the drum (2).

15. An assembly including a motor-driven system for separating non-magnetizable metals and ferrous fractions that are present, from a solid mixture, comprising a stator (1) and a drum (2) supported on the stator (1), the drum rotating around the stator, a rotating magnet rotor (4) including permanent magnets, the magnet rotor (4) being eccentrically arranged in the rotating drum (2) and supported on the stator (1), the stator (1) includes a balance weight (1.1) for providing mass balance and operating as an oscillation damper, the balance weight supported on the stator (1) and arranged in the rotating drum (2) a predetermined distance away from the stator (1) further comprising at least one separation apex (6) arranged subsequent to the assembly, wherein the separation apex (6) is adjusted by an adjusting device (9) in cooperation with a means for identifying (7) the composition of the separated ferrous fractions, wherein the identifying means is a camera.

16. An assembly including a motor-driven conveyor belt system for separating non-magnetizable metals and ferrous fractions that are present, from a solid mixture, comprising a stator (1) and a drum (2) supported on the stator (1), the drum rotating around the stator, a rotating magnet rotor (4) including permanent magnets, the magnet rotor (4) being eccentrically arranged in the rotating drum (2) and supported on the stator (1), the stator (1) includes a balance weight (1.1) for providing mass balance and operating as an oscillation damper, the balance weight supported on the stator (1) and arranged in the rotating drum (2) a predetermined distance away from the stator (1), wherein the drum (2) and the magnetic rotor (4) are formed as a header drum in a continuous conveyor belt system (5) that conveys the solid mixture and wherein a conveyor belt (5.1) of the conveyor belt system (5) has a guide projection (11) which is guided in a circumferential groove (12) of the drum shell (2.1).

17. An assembly including a motor-driven system for separating non-magnetizable metals and ferrous fractions that are present, from a solid mixture, comprising a stator (1) and a drum (2) supported on the stator (1), the drum rotating around the round the stator, a rotating magnet rotor (4) including permanent magnets eccentrically arranged in the rotating drum (2) and supported in the stator (1), the stator (1) includes a balance weight (1.1) for mass balance, wherein the drum (2) and the magnetic rotor (4) are formed as a header drum in a continuous conveyor belt system (5) that conveys the solid mixture, wherein a conveyor belt (5.1) of the conveyor belt system (5) has a guide projection (11) which is guided in a circumferential groove (12) of the drum shell (2.1) and wherein the conveyor belt system (5.1) is divided by a circumferential projection (10) into two regions, with a dedicated separation apex (6.1, 6.2) associated with each of these regions and arranged after these regions, wherein the separation apexes (6.1, 6.2) are adjustable independent of each other, whereby different materials of solid mixtures can be subjected to pre-cleaning and post-cleaning.

18. The assembly according to claim 17, wherein the upper edge of the separation apexes (6, 6.1, 6.2) is implemented as a rotating cylinder for improving the separation quality.

* * * * *

UNITED STATES PATENT AND TRADEMARK OFFICE

CERTIFICATE OF CORRECTION

PATENT NO. : 7,367,457 B2
APPLICATION NO. : 10/416784
DATED : May 6, 2008
INVENTOR(S) : Warlitz et al.

It is certified that error appears in the above-identified patent and that said Letters Patent is hereby corrected as shown below:

Column 2, line 2, "after the Fe – fraction has been separated" should read -- after the Fe–fraction has been separated --.

Column 2, line 11, "the purity if the recovered graded" should read -- the purity of the recovered graded --.

Column 4, line 33, "forms an angle about the rotation axis of the drum (2). said angle as well" should read -- forms an angle about the rotation axis of the drum (2), said angle as well --.

Column 4, line 37, "separation apexes (6.6.1.6.2) is implemented" should read -- separation apexes (6,6.1,6.2) is implemented --.

Signed and Sealed this

Sixteenth Day of September, 2008

JON W. DUDAS
*Director of the United States Patent and Trademark Office*